US007770931B2

(12) United States Patent
Lenhart

(10) Patent No.: US 7,770,931 B2
(45) Date of Patent: Aug. 10, 2010

(54) POLE GRIP

(75) Inventor: Klaus Lenhart, Ohmden (DE)

(73) Assignee: Lekisport AG, Baar (CH)

( * ) Notice: Subject to any disclaimer, the term of this patent is extended or adjusted under 35 U.S.C. 154(b) by 39 days.

(21) Appl. No.: 12/093,499

(22) PCT Filed: Nov. 27, 2006

(86) PCT No.: PCT/CH2006/000662

§ 371 (c)(1),
(2), (4) Date: May 13, 2008

(87) PCT Pub. No.: WO2007/062538

PCT Pub. Date: Jun. 7, 2007

(65) Prior Publication Data

US 2008/0231037 A1 Sep. 25, 2008

(30) Foreign Application Priority Data

Nov. 30, 2005 (CH) ..... 1901/05

(51) Int. Cl.
*A63C 11/22* (2006.01)

(52) U.S. Cl. ..... 280/821; 280/822

(58) Field of Classification Search ..... 280/821, 280/822

See application file for complete search history.

(56) References Cited

U.S. PATENT DOCUMENTS 5,092,629 A * 3/1992 Bagneres et al. ..... 280/821
5,110,154 A * 5/1992 Street ..... 280/822
5,123,674 A * 6/1992 Bagneres et al. ..... 280/821
5,312,134 A * 5/1994 Goode et al. ..... 280/822
5,328,205 A * 7/1994 Bacharach ..... 280/822
5,470,108 A * 11/1995 Goode et al. ..... 280/823
5,516,150 A * 5/1996 Goode et al. ..... 280/821
5,853,210 A * 12/1998 Robinson ..... 294/25
5,887,282 A * 3/1999 Lenhart ..... 2/159
5,988,681 A * 11/1999 Vesalainen et al. ..... 280/821
6,139,060 A * 10/2000 Lenhart ..... 280/821

(Continued)

FOREIGN PATENT DOCUMENTS

DE 94 01 287 U1 4/1994

(Continued)

*Primary Examiner*—Jeffrey J Restifo
(74) *Attorney, Agent, or Firm*—Sughrue Mion, PLLC

(57) ABSTRACT

A description is given of a handle (1) for in particular (cross-country) ski sticks and Nordic walking sticks, having a hand-retaining device (17), such as a hand loop or glove, which can be fastened in a releasable manner to the stick handle (1) via a coupling element (12) secured on the hand-retaining device (17), the stick handle (1) having a top end (22) and a bottom end (23), on or in which a stick tube can be, and/or is, fastened. A particularly straightforward releasable fastening arrangement which is stable, of reliable design and can also be utilized at low temperatures and in the presence of snow is made available by a retaining element (4) being provided on and/or in the stick handle (1), this retaining element having at least two lateral grooves (19) which are open essentially in opposite directions and, at least in certain regions, run essentially from top to bottom in respect of the stick handle (1), and by the coupling element (12) having, for the purpose of fastening on the retaining element (4), two corresponding protrusions which engage laterally in these grooves (19).

17 Claims, 3 Drawing Sheets

U.S. PATENT DOCUMENTS

| | | | | |
|---|---|---|---|---|
| 6,264,242 | B1 * | 7/2001 | Lenhart | 280/822 |
| 6,311,370 | B1 | 11/2001 | Blin | |
| 6,325,418 | B1 * | 12/2001 | Lenhart | 280/821 |
| 6,502,862 | B1 * | 1/2003 | Lenhart | 280/821 |
| 6,637,773 | B1 * | 10/2003 | Trinen et al. | 280/821 |
| 6,755,440 | B1 * | 6/2004 | Jones | 280/822 |
| RE38,573 | E * | 8/2004 | Wells | 280/822 |
| 6,851,437 | B1 * | 2/2005 | Lenhart | 135/72 |
| 6,988,745 | B2 * | 1/2006 | Trinen et al. | 280/821 |
| 7,226,084 | B2 * | 6/2007 | Lenhart | 280/822 |
| 7,322,612 | B2 * | 1/2008 | Trinen et al. | 280/821 |
| 2005/0225070 | A1 | 10/2005 | Lenhart | |
| 2008/0231037 | A1 * | 9/2008 | Lenhart | 280/821 |
| 2009/0174178 | A1 * | 7/2009 | Lenhart | 280/821 |

FOREIGN PATENT DOCUMENTS

| | | | |
|---|---|---|---|
| DE | 196 36 852 | C1 | 2/1998 |
| DE | 200 06 724 | U1 | 8/2000 |
| DE | 299 04 591 | U1 | 8/2000 |
| EP | 0 370 900 | A1 | 5/1990 |
| WO | 03/022377 | A1 | 3/2003 |
| WO | 2004/052476 | A1 | 6/2004 |

* cited by examiner

POLE GRIP

CROSS REFERENCE TO RELATED APPLICATIONS

This application is a National Stage of International Application No. PCT/CH2006/000662 filed on Nov. 27, 2006, claiming priority based on Switzerland Patent Application No. 01901/05, filed Nov. 30, 2005, the contents of all of which are incorporated herein by reference in their entirety.

TECHNICAL FIELD

The present invention relates to a pole grip for, in particular, cross-country ski poles, downhill ski poles and Nordic walking poles, having a hand-retaining device, such as a hand strap or glove, which can be fastened in a releasable manner to the pole grip via a coupling element secured on the hand-retaining device, the pole grip having a top end as well as a bottom end, on or in which a pole shaft can be fastened and/or is fastened.

PRIOR ART

There is an increasing need, as far as cross-country ski poles, downhill ski poles and Nordic walking poles are concerned, for the hand strap, or a correspondingly specially configured glove, to be connected in a releasable manner to the pole grip rather than being fixed thereto. Correspondingly, a wide variety of different designs which allow such hand-retaining devices to be connected in a releasable manner to a pole grip have already been proposed.

In the case of the pole grip which is known from DE-A-196 36 852, the pole-grip recess is accessible, from a peripheral side, for the first connecting element, which is fixed to the hand strap, and is covered, on the end side of the grip head, by a release cover and the actuating member. The actuating member can be moved in the axial direction of the pole grip and is coupled to the second connecting element in order to move the latter axially. In the case of this known pole grip, the access to and exit from, the pole-grip recess are thus arranged essentially perpendicularly to one another, which is expedient for the configuration of, in particular, downhill ski poles since the grips for such poles are usually provided with a slightly curved grip-head end side which runs essentially perpendicularly to the pole axis.

In the case of a pole grip which is known from EP-A-0 370 900, the pole-grip recess contains an actuating lever for clamping the hand-strap connecting element in place, which actuating lever can be moved manually, counter to the action of a spring, out of its release position into its clamping position. The connecting element of the hand strap here is pushed into the pole-grip recess perpendicularly to the longitudinal axis of the pole.

In the case of the pole grip which is known from DE 299 04 591 U1, the pole-grip recess between the access for the first connecting element of a hand strap and the opposite exit opening for the actuating member runs at an acute angle to the longitudinal axis of the pole grip or ski pole. This means that the connecting element which is secured on the hand strap is latched in obliquely from beneath the top pole-grip end and is removed obliquely downward in the opposite direction. Since the actuating member and the second connecting member are in one piece and, since the pivot axis is arranged at the end of the second connecting member, are designed as a single-armed lever, the latching-in action, on account of the latching region being very close to the pivot axis, is problematic and requires a high level of force to be exerted. Moreover, the direction of latching in the first connecting element on the hand strap behind the second connecting element on the single-armed actuating lever does not give rise to an ergonomic movement, and this movement, moreover, is difficult to carry out using just one hand.

WO-A-2004052476 describes a pole grip having a hand-retaining device which is in the form of a hand strap or a glove and can be latched in a releasable manner to the pole grip via a first connecting element secured on the hand-retaining device. A pole-grip recess here contains a second connecting element which interacts with the first connecting element and can be moved, counter to resilient mounting, by means of an actuating member which is accessible in the region of the grip head. In order for it to be possible for the hand-retaining device to be more easily and ergonomically fastened in a releasable manner, it is provided that the access to the pole-grip recess into which the first connecting elements can be inserted, and from which it can be removed, is formed by a longitudinal slot which runs parallel to the longitudinal axis of the pole grip, or in an inclined manner in relation thereto, in a first wall, which is directed toward the location of the hand-retaining device and bounds the pole-grip recess, the longitudinal slot extending in over a region from above to beneath the movement region of the second connecting element. As seen in a section perpendicular to the running direction of the slot, the longitudinal slot here is, to a certain extent, of T-shaped design, i.e. it has an entry channel or longitudinal slot from which extends, in the interior of the pole grip, two channel-widening grooves which are directed toward one another. The connecting element has a stem, which is guided in this longitudinal slot or channel, and a head, which widens this stem to the side and thereby engages in the grooves by way of lateral ribs.

The problem with such a design, under certain circumstances, is the fact that dirt or snow/ice can penetrate into the longitudinal slot, or into the grooves of the same which are concealed in the interior of the pole grip, and, correspondingly, it is then no longer possible for the connecting element to be inserted.

DESCRIPTION OF THE INVENTION

Accordingly, the object of the invention, inter alia, is to propose an alternative pole-grip construction which is of straightforward design and, inter alia, can also be handled easily at all times when in contact with snow. The concern here, in particular, is to improve a pole grip for in particular, cross-country ski poles, downhill ski poles and Nordic walking poles, having a hand-retaining device, such as a hand strap or glove, which can be fastened in a releasable manner to the pole grip via a coupling element secured on the hand-retaining device, the pole grip having a top end as well as a bottom end, on or in which a pole shaft can be fastened and/or is fastened.

This object is achieved, inter alia, in that provided in, but in particular preferably on, the pole grip is a retaining element which has at least two lateral grooves which are open essentially in opposite directions and, at least in certain regions, run essentially from top to bottom in relation to the pole grip, and in that the coupling element, for fastening on the retaining element, has two corresponding protrusions or ribs engaging laterally in these grooves. Lateral grooves on the retaining element which are open in opposite directions is intended to be understood, as can be gathered unequivocally from the language used and, in particular, from the following, as meaning that the grooves on the retaining element are arranged on both sides, i.e. indeed laterally, and are open in the direction of the outside, i.e. indeed are open essentially in opposite directions.

In the case of the prior-art designs, the fastening of the retaining device on the pole grip is always ensured via a coupling element which has to be pushed into a recess in the pole grip. The problem with such solutions, inter alia, is that the corresponding recess can become blocked in particular on contact with dirt, snow or ice and, correspondingly, it is no longer possible, in these conditions, for the retaining device to be fastened. This is the case, for example, in WO 2004/052476, which was discussed in the introduction. In this document, on the one hand, there is no retaining element provided on the pole grip on which a coupling element can be fastened; rather, a pole-grip recess is provided there. Also provided there is a longitudinal slot containing grooves which are directed toward one another rather than grooves which are open laterally in opposite directions. Correspondingly, for example, a solution such as that in WO 2004/052576 is problematic in respect of dirt.

The core of the invention, then, is to provide an, as it were, external but nevertheless functionally optimal design in the case of which in particular preferably the coupling element can be pushed into the grooves in the retaining device, for example, from above by way of the two protrusions, and the above problems can thus be avoided.

In addition, it has been found that such designs in which there is no need, in principle, for a recess in the pole grip can be rendered more stable as a result of the solid construction.

Such designs are basically possible without any need for a mechanism for the latching in of the coupling element if, for example, the grooves are curved or sufficiently long. According to a first preferred embodiment, however, the coupling element can be latched in a releasable manner on the retaining element.

A further preferred embodiment is characterized in that the two grooves of the retaining element, as seen in or along the running direction, are open at their first end, in which case the coupling element can be pushed in at this first end of the grooves, and in that the two grooves of the retaining element, as seen in the running direction, are closed at their second end, in which case, once it has been pushed in, the coupling element stops against this second end, this stop position defining the state in which the coupling element is fastened on the retaining element for use. In view of the hand-retaining device usually being subjected to downward pulling during use, the open ends of the grooves here are preferably open in the upward direction, and the closed ends of the grooves are closed in the downward direction, in which case the coupling element, for fastening on the retaining element, is pushed onto the retaining element from above, preferably with latching-in action.

As an alternative, it is possible for the grooves to be designed to be closed at the top and bottom and for the widened portion in front of the grooves to taper in the top region, at least over a height corresponding to the height of the coupling element, to the width of the retaining web, in which case the coupling element, in this region, can be inserted, as it were, horizontally and then pushed downward.

In general, the grooves mentioned in the introduction may have a depth in the range from 0.5-5 mm, in particular preferably in the range from 1-3 mm. In general, they may have a width in the range from 0.5-5 mm, in particular preferably in the range from 1-3 mm.

The coupling element is preferably designed as a rigid element in the manner of a clip, C-profiled rail portion or the like, preferably in one piece. The coupling element may be produced from metal or from plastic. In the same way, the pole grip may be produced, for example, from a thermoplastic material, or else also from cork, rigid plastic or from a combination of these materials or the like.

The coupling element is preferably designed, in cross section, in the form of a clamp or of a clip which has a recess in the form of a through-opening, the through-opening being opened, as seen in the running direction, toward the side directed toward the retaining element, so as to form two lateral protrusions adapted to the grooves. As seen in a section perpendicular to the running direction of the through-opening, this correspondingly results, as it were, in a C-shaped profile which may be of basically different shapes, for example angular (polygonal), oval or round (circular).

A further preferred embodiment is characterized in that the retaining element is positioned on the hand side of the pole grip, on the outside of the pole grip, in the region of the top end of the pole grip. In the case of such a construction, sensitivity in respect of dirt, snow or ice can be kept to a minimal level. The retaining element here may be designed as a metal rail, for example with a T-like profile, in which case the crossbar of the T-profile serves for fastening the coupling element and the vertical bar has its bottom end fastened on the pole grip. In particular, the retaining element preferably has a length, running in the running direction of the pole grip, which is at least greater, in particular preferably 2-10 times greater, than the width of the retaining element as seen perpendicularly to the running direction of the pole grip, that is to say than the width as seen transversely to the running direction of the pole grip.

The retaining element may have a retaining web, which runs from top to bottom and is fastened on the pole grip, and a widened portion, which runs from top to bottom (and may be round or angular in the manner of a bar), it being the case that the width of the retaining web is smaller than the width of the widened portion, and that the width of the retaining web may be, for example, in the range from 1-10 mm, in particular preferably in the range from 2-5 mm, and the width of the widened portion may be, for example, in the range from 2-15 mm, in particular preferably in the range from 3-10 mm.

The pole grip, preferably in the region of the top end, has a recess in which is arranged a locking mechanism, in particular preferably in the form of a locking lever, which blocks the coupling element with self-latching action, in particular preferably with at least the indirect aid of the restoring force of a spring or of a resilient element or even with the aid of the elastic deformation of the locking lever itself, in the position in which it is fastened on the retaining element, which locking mechanism or locking lever can be actuated by the user from the outside, in particular preferably from the top side, or even from the side, of the pole grip, in order to release the coupling element. The locking lever (for example made of metal or plastic) is preferably a locking lever which is mounted in a rotatable manner via a pin, projects out of the pole grip, essentially at the top end of the same, through a top opening of the recess, and projects through a bottom opening of the recess by way of a locking nose such that the coupling element can be pushed in from above without any additional actuation of the locking lever, the locking nose latching in automatically in the process. This is possible, for example, by the locking lever being arranged obliquely, in which case it has a beveled flank past which the coupling element can be drawn, preferably with self-latching action, as it is pushed in.

The present invention also relates to a glove or a hand strap having a coupling element as has been described above, that is to say in particular in the form of a single-piece clamp which is made of metal or plastic and is capable of engaging in the above-mentioned grooves by way of the protrusions. It is preferably the case with a glove that the coupling element is fastened in the region between the thumb and forefinger, it being possible for fastening to take place via rivets, or else also via appropriate stitched or adhesive-bonding connections. It is also possible for the coupling element to be integrally formed on the strap by injection molding. The hand strap is preferably one which can be fastened on the user's hand for example with the aid of a touch-and-close fastener, for example a hand strap which has three openings, one for the wrist, one for the thumb and one for the back of the hand or the other four fingers.

The present invention additionally relates to a cross-country ski pole, downhill ski pole and/or Nordic walking pole having a pole grip as has been described above.

Further preferred embodiments of the invention are described in the dependant claims.

BRIEF EXPLANATION OF THE FIGURES

The invention will be explained in more detail hereinbelow with reference to exemplary embodiments and in conjunction with the drawings, in which.

WAYS OF IMPLEMENTING THE INVENTION

The invention will be explained hereinbelow with reference to exemplary embodiments. The exemplary embodiments here serve exclusively for illustrating and explaining the functioning of the invention, but are not to be seen as in any way restricting the scope of protection as defined in the appended patent claims.

Figure 1:
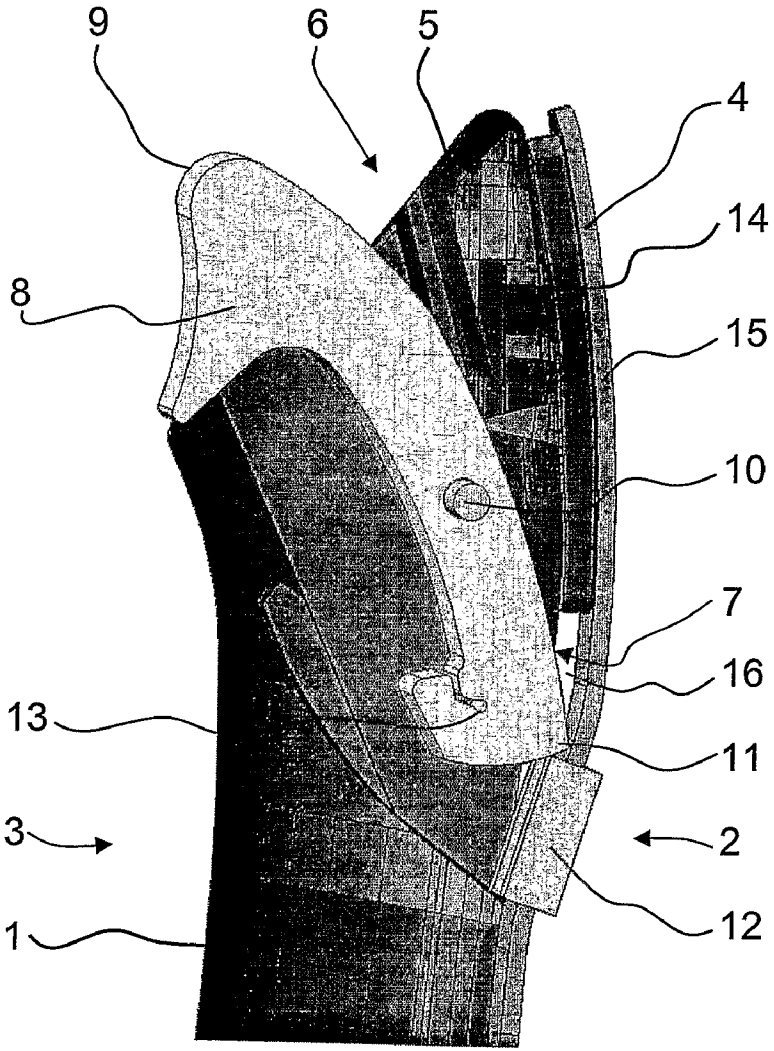
FIG. 1 shows a perspective view of the head region of a pole grip, part of the housing having been omitted in order to give a better view of the internal components.
Figure 2:
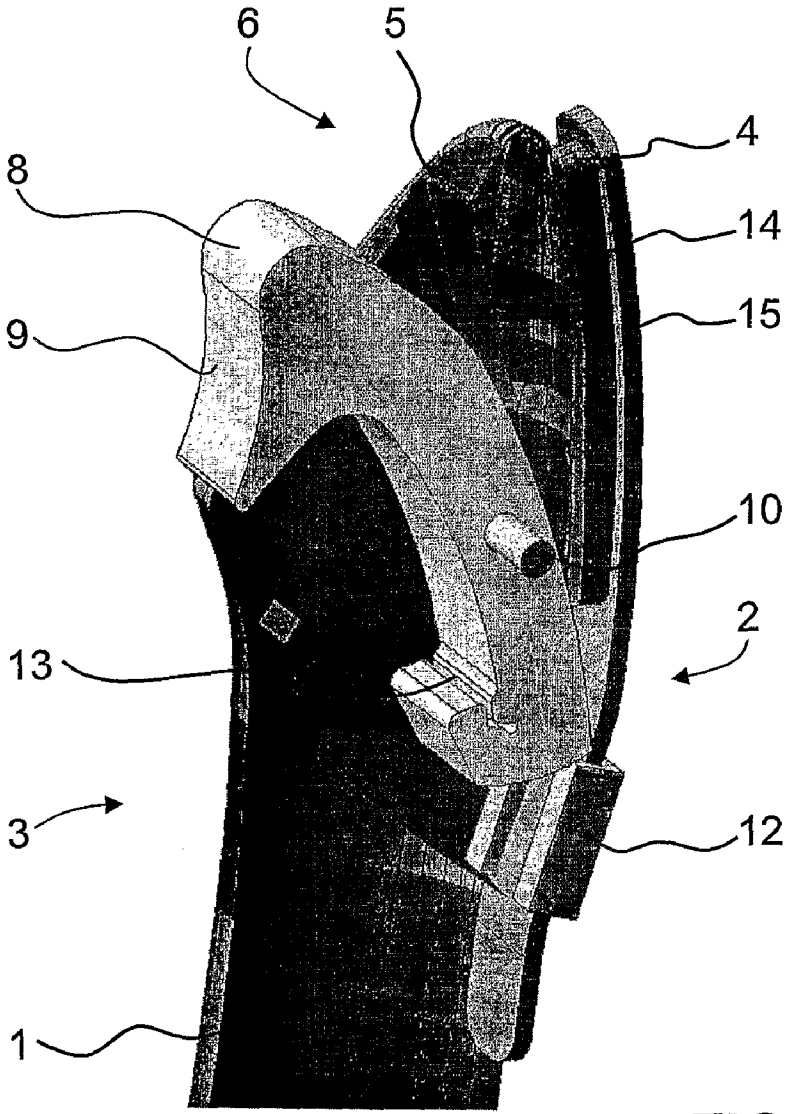
FIG. 2 shows the head region according to FIG. 1 from a different direction.
Figure 3:
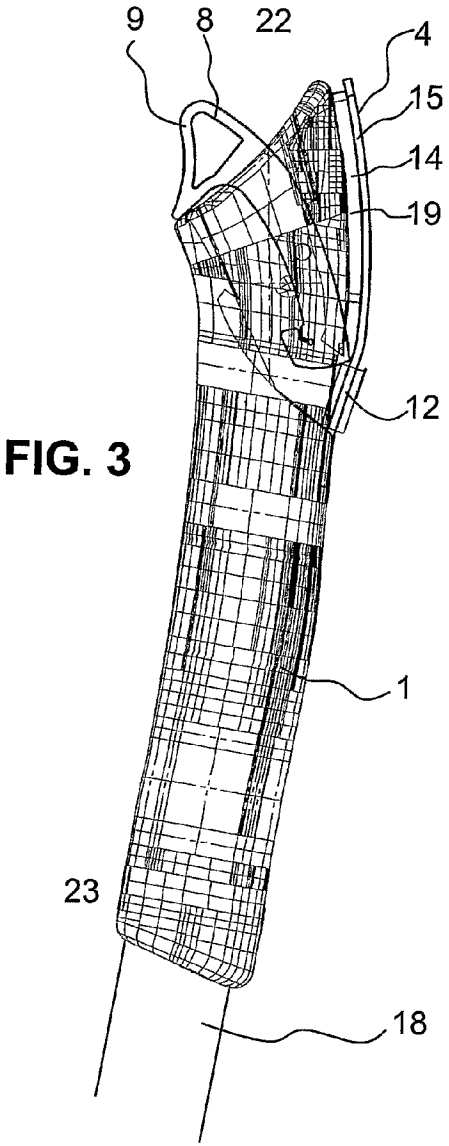
FIG. 3 shows a contoured illustration of a pole grip in its entirety.

FIGS. 1 and 2 illustrate the head region of a pole grip 1, the housing on the viewer's side having been removed in order to give a better view of the components arranged in a recess 5. FIG. 3 depicts a transparent contoured illustration of the same pole grip.

The pole grip 1 has a hand side 2 against which usually the palm of the hand, in particular the region between the thumb and forefinger, rests during use. The front side 3 is located opposite. The top end is designated 22, and the bottom end is designated 23. At the bottom end, the pole grip 1 has a recess into which the pole shaft 18 has been pushed. The pole shaft, at its bottom end, has a pole tip (not illustrated).

The recess 5, which, in the direction of the top end 22, has a top opening 6 and, obliquely downward in the direction of the hand side 2, has a bottom opening 7, contains a locking lever 8. This locking lever 8 is mounted in a rotatable manner about a pin 10. The locking lever 8 projects out of the pole grip 1 in the direction of the top end of the latter to form an actuating region 9. There, the locking lever 8 can be actuated, for example, by the hand or a finger if the hand-retaining device 17 is to be released from the pole grip 1. The locking lever 8 is braced in the recess 5 by means of a spring (not illustrated), in which case, in an illustration according to FIGS. 1-3, it is subjected to force in the counterclockwise direction. The spring here may be, for example, a leaf spring which is fastened in a slot 13 in the locking lever, but it may also be in the form of correspondingly arranged helical springs, leg springs or elastomeric elements. The locking lever has its bottom end projecting out of the bottom opening 7, and the bottom tip of the locking lever 8 forms a locking nose 11.

An elongate retaining element 4 is arranged on the hand side, in the uppermost region of the pole grip 1. It essentially comprises a T-shaped profile made of metal or plastic, the crossbar of this profile being the widened portion 15 and the other bar being the retaining web 14, which is fastened on the pole grip 1. The retaining web here extends over a first part; in the region of the bottom opening 7, however, there is a region 16 in which the retaining web 14 has been omitted. Correspondingly, there, the locking nose 11 can project right up to the widened portion 15. The retaining element 4 correspondingly forms two lateral grooves 19 which extend essentially along the running direction of the pole grip 1 and are arranged opposite one another. The grooves 19 are open in the direction of the top end 22 of the pole grip 1, but are closed in the direction of the bottom end such that the coupling element 12, which in FIGS. 1-3 is illustrated in the position in which it is fastened on the pole grip, comes to a stop as it reaches the lowermost position. The locking nose 11 here is arranged essentially above the top edge of the coupling element 12 in the lowermost position.

It is also possible, as it were, to dispense with the entire top region of the retaining element 4, i.e. it is possible to allow the widened portion 15 to project, as seen in FIG. 1, only to some way beyond the position of the locking nose 11, as it were in the manner of a hook. All that is then required is for the coupling element 12 to be pushed onto the retaining element 4 over a significantly shorter distance, and the design becomes narrower.

This design makes it possible for the coupling element 12 to be pushed into the upwardly open grooves 19 from above and moved downward. When the locking nose is reached, the latter is deflected into the interior of the pole grip 1 counter to the spring force, which allows the coupling element 12 to slide into the lowermost position, that is to say until its stop. When the lowermost position has been reached, the locking lever moves back again in the counterclockwise direction and thus locks the coupling element 12. Correspondingly, this mechanism provides a self-latching design.

Should the user wish to release the coupling element again from the pole grip, then he actuates the actuating region 9 (pressing in the clockwise direction) until the locking nose 11 releases the coupling element 12 and the latter can be pushed out of the retaining element 4 once again in the upward direction.

Figure 4:
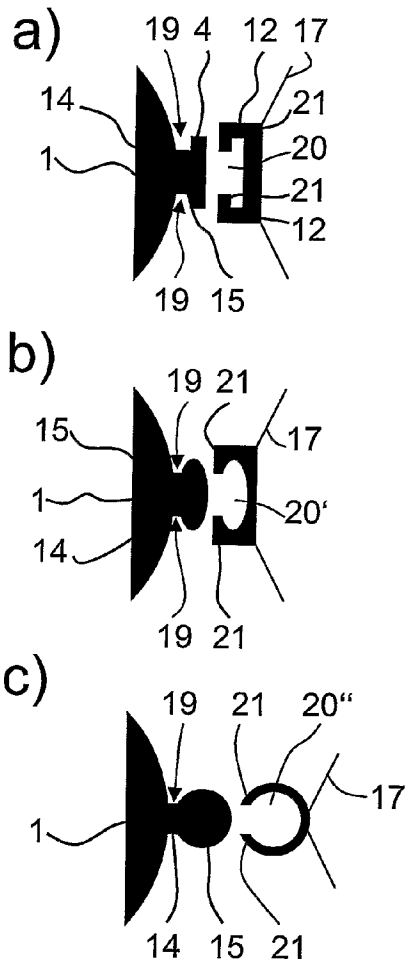
FIGS. 4*a*)-*c*) show sections through different retaining elements and coupling elements, the sections being taken along a plane essentially perpendicular to the running direction of a pole grip.

FIG. 4 illustrates different configurations of the retaining element 4 and coupling element 12. FIGS. 4*a*)-*c*) each illustrate a section taken along a plane perpendicular to the axis of the pole grip 1. Each figure shows the longitudinally running grooves 19 arranged on both sides and the T-shaped profile of the retaining element 4.

FIG. 4*a*) shows the exemplary embodiment as has been illustrated in FIGS. 1-3. In this case, the coupling element 12 fastened on the hand-retaining device 17 is, as it were, an angular, C-shaped clip which has an undercut recess 20 which is configured as a through-opening and gives rise to two elongate protrusions arranged opposite one another. The coupling element 12 has, for example, a height (as seen perpendicularly to the plane of the paper in FIG. 4) in the range from 2-15 mm, preferably in the range from 4-10 mm. It is generally produced, for example, from metal (aluminum) or from plastic (possibly fiber-reinforced plastic) or else from a combination, e.g. from a metal encapsulated, coated or sheathed by plastic.

An alternative embodiment is illustrated in FIG. 4*b*). The widened portion 15 here, rather than being an angular cross-bar, is an oval widened portion. Such a design with no edges may be desirable if, for example, the risk of injury is to be kept low. In the case of FIG. 4*b*), as far as the coupling element 12 is concerned, only the shape of the recess 20' is, correspondingly, likewise oval; the external shape, however, remains angular. It is, of course, also possible for the external shape to be rounded as well. FIG. 4*c*) illustrates a fully rounded design. In this case, the widened portion 15 is configured as a round pin which is connected to the pole grip via the retaining web 14. Correspondingly, the coupling element 12 is designed as a straightforward tube portion which has a slot on one side, in which case the retaining web 14 can be arranged in this region when the coupling element is pushed onto the retaining element 4.

LIST OF DESIGNATIONS

1 Pole grip
2 Hand side
3 Front side
4 Retaining element
5 Recess in 1
6 Top opening of 5
7 Bottom opening of 5
8 Locking lever
9 Actuating region of 8
10 Pin of 8
11 Locking nose
12 Coupling element, clamp
13 Slot for leaf spring or the like
14 Retaining web of 4
15 Widened portion/transverse element of 4
16 Region of 4 without 14
17 Hand-retaining device, in particular glove or hand strap
18 Pole shaft
19 Notch, groove
20 Undercut recess, angular
20' Undercut recess, oval
20" Undercut recess, round
21 Protrusion, rib
22 Top end of 1
23 Bottom end of 1

The invention claimed is:

1. A pole grip for at least one of cross-country ski poles, downhill ski poles and Nordic walking poles, having a hand-retaining device, such as a hand strap or glove, which can be fastened in a releasable manner to the pole grip via a coupling element secured on the hand retaining device, the pole grip having a top end as well as a bottom end, on or in which a pole shaft can be fastened or is fastened, wherein provided on or in the pole grip is a retaining element which has at least two lateral grooves which are open essentially in opposite lateral directions and, at least in certain regions, run essentially from top to bottom in relation to the pole grip, wherein the coupling element, for fastening on the retaining element, has two corresponding protrusions engaging laterally in said lateral grooves, wherein the coupling element can be latched in a releasable manner on the retaining element, wherein the at least two lateral grooves of the retaining element, as seen in their running direction, are open in an upward directed end, such that the coupling element can be pushed into said lateral grooves from above at said upward directed end, and wherein the at least two lateral grooves of the retaining element, as seen in their running direction, are closed at a bottom end, in which case, once a coupling element has been pushed into a lateral groove, the coupling element stops at a stop position against said bottom end, said stop position defining a state in which the coupling element is fastened on the retaining element for use, wherein the coupling element is designed in the form of a clamp or a clip which has a recess in the form of a longitudinal through-opening, the through-opening being open, along the running direction, toward the side directed toward the retaining element, so as to form two lateral protrusions adapted to and for interlocking with the grooves on the pole grip, and wherein the length of the coupling element in the running direction of the grooves is smaller than the length of the grooves.

2. The pole grip as claimed in claim 1, wherein the coupling element is designed as a rigid element, in one piece.

3. The pole grip as claimed in claim 1, wherein the through-opening is one of angular, oval or round design.

4. The pole grip as claimed in claim 1, wherein the retaining element is positioned, or integrally formed, on the hand side of the pole grip, on the outside of the pole grip, in the region of the top end of the pole grip.

5. The pole grip as claimed in claim 4, wherein the retaining element has a retaining web, which runs from top to bottom and is fastened or integrally formed on the pole grip, and a widened portion, which runs from top to bottom, it being the case that the width of the retaining web is smaller than the width of the widened portion.

6. The pole grip as claimed in claim 4, wherein the retaining element has a retaining web, which runs from top to bottom and is fastened or integrally formed on the pole grip, and a widened portion, which runs from top to bottom, it being the case that the width of the retaining web is smaller than the width of the widened portion, wherein the width of the retaining web is in the range from 2-5 mm, and the width of the widened portion is in the range from 3-10 mm, and wherein the widened portion, and possibly the retaining web, is a linear or curved rail which is fastened in a form-fitting or force-fitting manner on the hand 5 side of the pole grip.

7. The pole grip as claimed in claim 1, wherein the pole grip in the region of the top end, has a recess in which is arranged a locking mechanism, which blocks the coupling element with self-latching action, in the position in which it is fastened on the retaining element, and which locking mechanism or locking lever can be actuated by the user from the outside, in order to release the coupling element.

8. The pole grip as claimed in claim 1, wherein the retaining element is positioned, or integrally formed, on the hand side of the pole grip, on the outside of the pole grip, in the region of the top end of the pole grip, it being the case that the retaining element has two laterally outwardly open grooves, with a base, which run on opposite sides 5 of the retaining element, essentially from top to bottom in relation to the pole grip, wherein the retaining element has a length, running in the running direction of the pole grip, which is at least 10 greater than the width of the retaining element as seen perpendicularly to the running direction of the pole grip.

9. The pole grip as claimed in claim 1, wherein the retaining element is positioned, or integrally formed, on the hand side of the pole grip, on the outside of the pole grip, in the region of the top end of the pole grip, it being the case that the retaining element has two laterally outwardly open grooves, with a base, which run on opposite sides of the retaining element, essentially from top to bottom in relation to the pole grip, wherein the retaining element has a length, running in the running direction of the pole grip, which is 2-10 times greater than the width of the retaining element as seen perpendicularly to the running direction of the pole grip.

10. The pole grip as claimed in claim 1, wherein the pole grip, in the region of the top end, has a recess in which is arranged a locking mechanism, in the form of a locking lever, which blocks the coupling element with self-latching action, with at least the indirect aid of the restoring force of a spring, in the position in which it is fastened on the retaining element, and which locking mechanism or locking lever can be actuated by the user from the outside, from the top side of the pole grip, in order to release the coupling element.

11. A pole grip for at least one of cross-country ski poles, downhill ski poles and Nordic walking poles, having a hand-retaining device, in the form of a hand strap or a glove, which can be fastened in a releasable manner to the pole grip via a coupling element secured on the hand-retaining device, the pole grip having a top end as well as a bottom end, on or in which a pole shaft can be fastened or is fastened, wherein provided on or in the pole grip is a retaining element which has at least two lateral grooves which are open essentially in opposite directions and, at least in certain regions, run essentially from top to bottom in relation to the pole grip, wherein the coupling element, for fastening on the retaining element, has two corresponding protrusions engaging laterally in the lateral grooves, wherein the pole grip, in the region of the top end, has a recess in which is arranged a locking mechanism in the form of a locking lever, wherein the locking lever is mounted in a rotatable manner via a pin, projects out of the pole grip, essentially at the top end of the pole grip, through a top opening of the recess, and projects through a bottom opening of the recess by way of a locking nose such that the coupling element can be pushed in from above without any additional actuation of the locking lever, the locking nose latching in automatically in the process.

12. A glove or hand strap having a coupling element as claimed in claim 1 or claim 11, wherein in case of a glove, the coupling element is fastened in the region between the thumb and forefinger, and wherein in case of a hand strap, the hand strap can be fastened on the user's hand with the aid of a touch-and-close fastener.

13. A cross-country ski pole, downhill ski pole and/or Nordic walking pole having a pole grip as claimed in claim 1 or claim 11.

14. The pole grip as claimed in claim 1 or claim 11, wherein the grooves have a depth in the range from 0.5-5 mm.

15. The pole grip as claimed in claim 1 or claim 11, wherein the grooves have a depth in the range from 1-3 mm.

16. The pole grip as claimed in claim 1 or claim 11, wherein the grooves have a width in the range from 0.5-5 mm.

17. The pole grip as claimed in claim 1 or claim 11, wherein the grooves have a width in the range from 1-3 mm.

* * * * *